US005397248A

United States Patent [19]

Whiteman, Jr. et al.

[11] Patent Number: 5,397,248

[45] Date of Patent: * Mar. 14, 1995

[54] ELECTRICAL CONNECTOR FOR BACK PANEL MOUNTING

[75] Inventors: Robert N. Whiteman, Jr., Middletown; Charles H. Weidler, Lancaster, both of Pa.

[73] Assignee: The Whitaker Corporation, Wilmington, Del.

[ * ] Notice: The portion of the term of this patent subsequent to Feb. 22, 2011 has been disclaimed.

[21] Appl. No.: 286,066

[22] Filed: Aug. 4, 1994

Related U.S. Application Data

[62] Division of Ser. No. 149,409, Nov. 9, 1993, which is a division of Ser. No. 43,319, Apr. 6, 1993, Pat. No. 5,288,246.

[51] Int. Cl.[6] ..... H01R 13/73

[52] U.S. Cl. ..... 439/571; 439/540; 439/498

[58] Field of Search ..... 439/540, 571, 498, 701, 439/573

[56] References Cited

U.S. PATENT DOCUMENTS

| | | | |
|---|---|---|---|
| 3,727,168 | 4/1973 | Henschen et al. | 439/498 |
| 4,470,656 | 9/1984 | Moser et al. | 439/535 |
| 4,493,524 | 1/1985 | Kaplan et al. | 439/573 |
| 4,880,388 | 11/1989 | Beamenderfer et al. | 439/108 |
| 4,925,401 | 5/1990 | Fogg et al. | 439/465 |
| 4,959,030 | 9/1990 | Tatebe et al. | 439/498 |
| 4,973,264 | 11/1990 | Kamono et al. | 439/498 |
| 5,184,961 | 2/1993 | Ramirez et al. | 439/540 |
| 5,230,638 | 7/1993 | DiVesti | 439/571 |
| 5,314,357 | 5/1994 | Weidler et al. | 439/701 |

*Primary Examiner*—Gary F. Paumen

[57] ABSTRACT

A panel mounted electrical connector is disclosed in combination with an equipment rack, multiple units of electronic equipment arranged in the rack, each unit having a connector in mating engagement with the connector mounted on the back panel of the rack. The panel mounted connector is arranged to align and hold in proper position multiple connectors, thereby forming a composite connector that mates with a mating composite connector on the unit of electronic equipment. Cutouts are provided in a surface of the composite connector so that cabling that is terminated to the connector may exit the connector at right angles thereto substantially parallel with the back panel.

18 Claims, 5 Drawing Sheets

ELECTRICAL CONNECTOR FOR BACK PANEL MOUNTING

This application is a divisional of application Ser. No. 08/149,409 filed Nov. 9, 1993, in turn, a divisional application of application Ser. No. 08/043,319, filed Apr. 6, 1993, now U.S. Pat. No. 5,288,246.

The present invention relates to an electrical connector of the type that combines multiple connectors into a single connector unit that is mounted to the back panel of an equipment rack.

BACKGROUND OF THE INVENTION

It is common practice in the industry to individually mount connectors to the back panel, or back plane of an equipment rack. In doing this care must be taken to assure that the individual connectors are in proper alignment so that when the drawer containing the unit of equipment is inserted into the rack, the connectors of the unit properly mate with the connectors mounted to the back panel. Additionally, when the connectors are mounted to the back panel on the unit side, the interconnect cables must exit the connectors through openings cut through the panel. What is needed is a connector that is a composite of the connectors that are required by a particular unit of equipment so that these connectors are automatically held in the proper alignment with respect to one another and a provision for exiting the interconnect cables without the need for openings in the back panel.

SUMMARY OF THE INVENTION

The present invention sets forth a novel interconnection system for interconnecting electronic equipment units with back plane wiring in an equipment rack. An electrical connector for mounting to a panel of an equipment rack is provided wherein a unit of equipment having a mating connector attached thereto is arranged to slide within the rack so that the two connectors engage and electrically mate when the unit is fully inserted into the rack. The electrical connector includes a housing having multiple cavities and multiple connectors in the cavities. Walls of the cavities engage the external surfaces of each of the multiple connectors to accurately position and hold them with respect to the housing. The housing includes a mounting face for mounting against the panel.

DESCRIPTION OF THE PREFERRED EMBODIMENT

Figure 1:
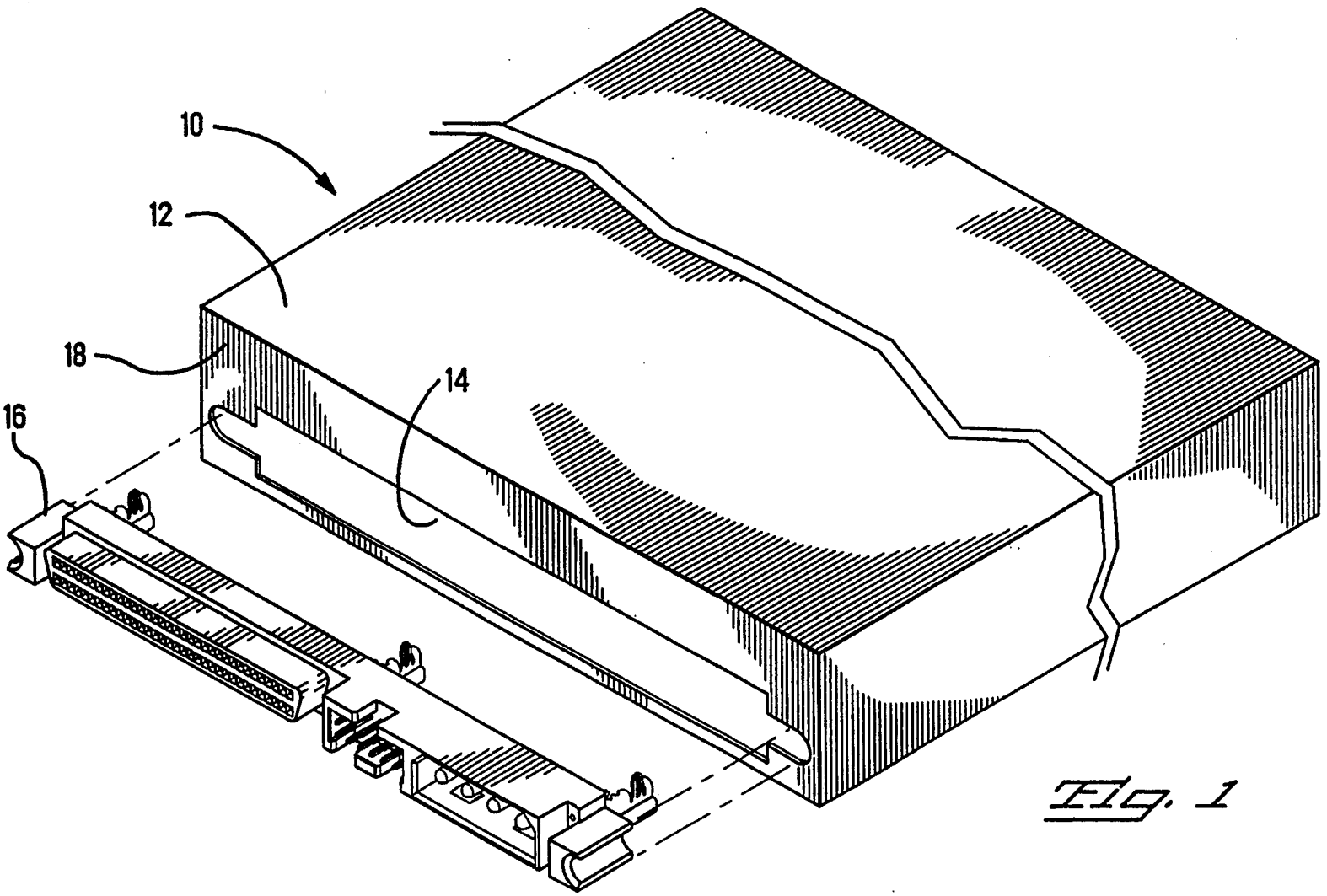
FIG. 1 is a perspective view of a disc drive unit of the type that is utilized in the practice of the present invention.
Figure 2:
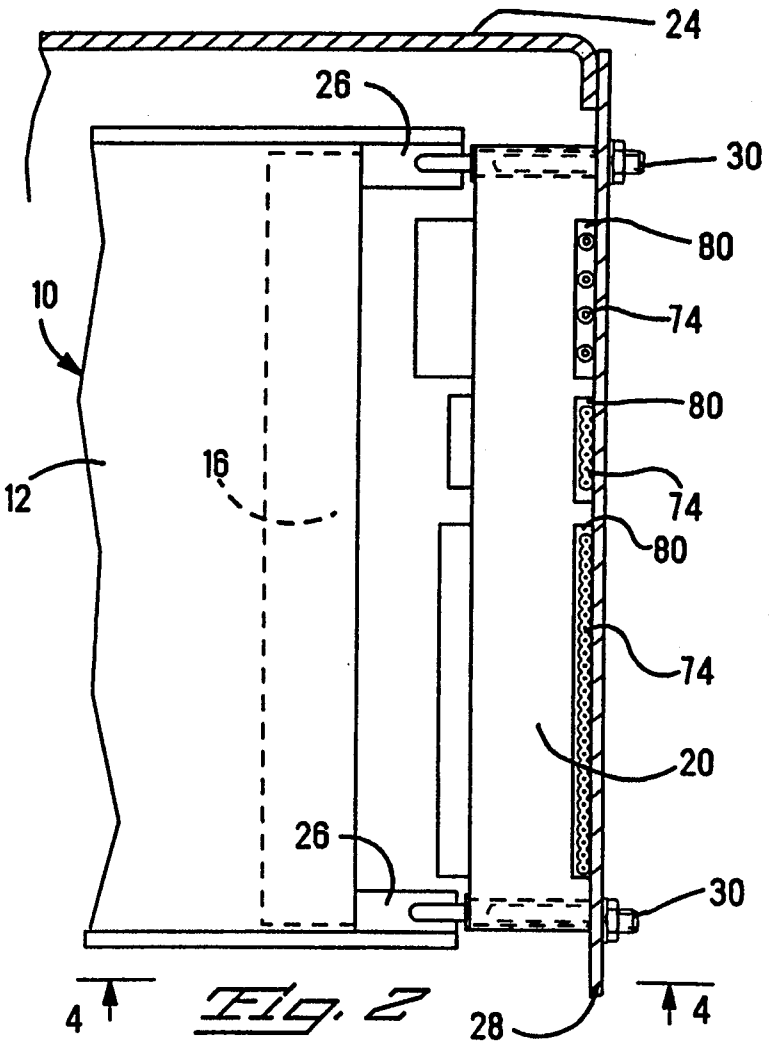
FIG. 2 is a partial cross-sectional view showing an equipment rack with the unit shown in FIG. 1.
Figure 3:
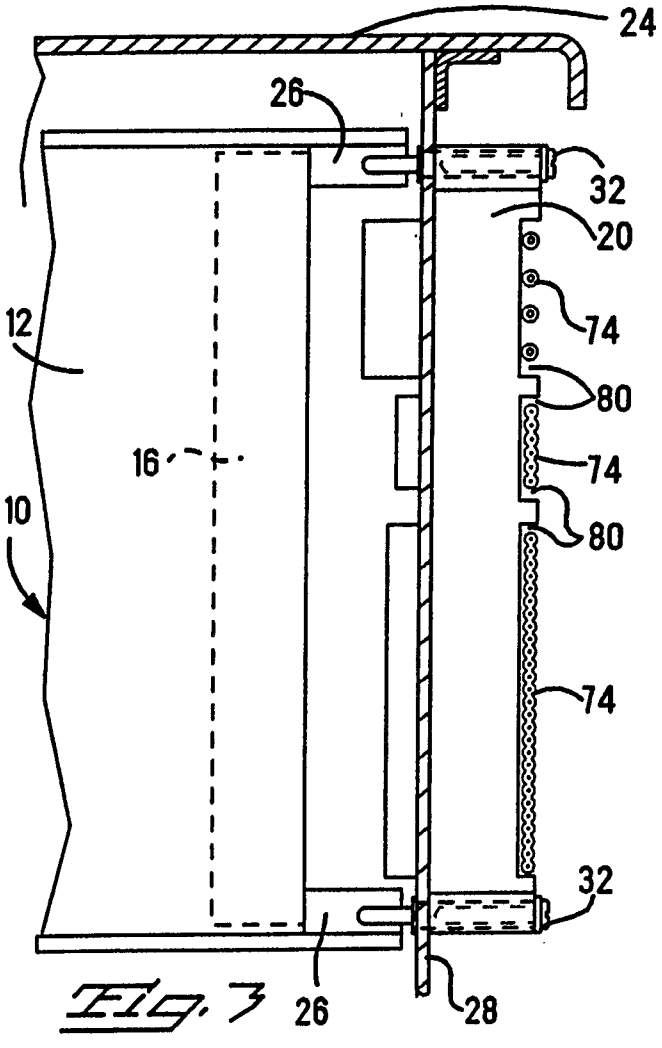
FIG. 3 is a view similar to that of FIG. 2 showing an alternative arrangement.
Figure 4:
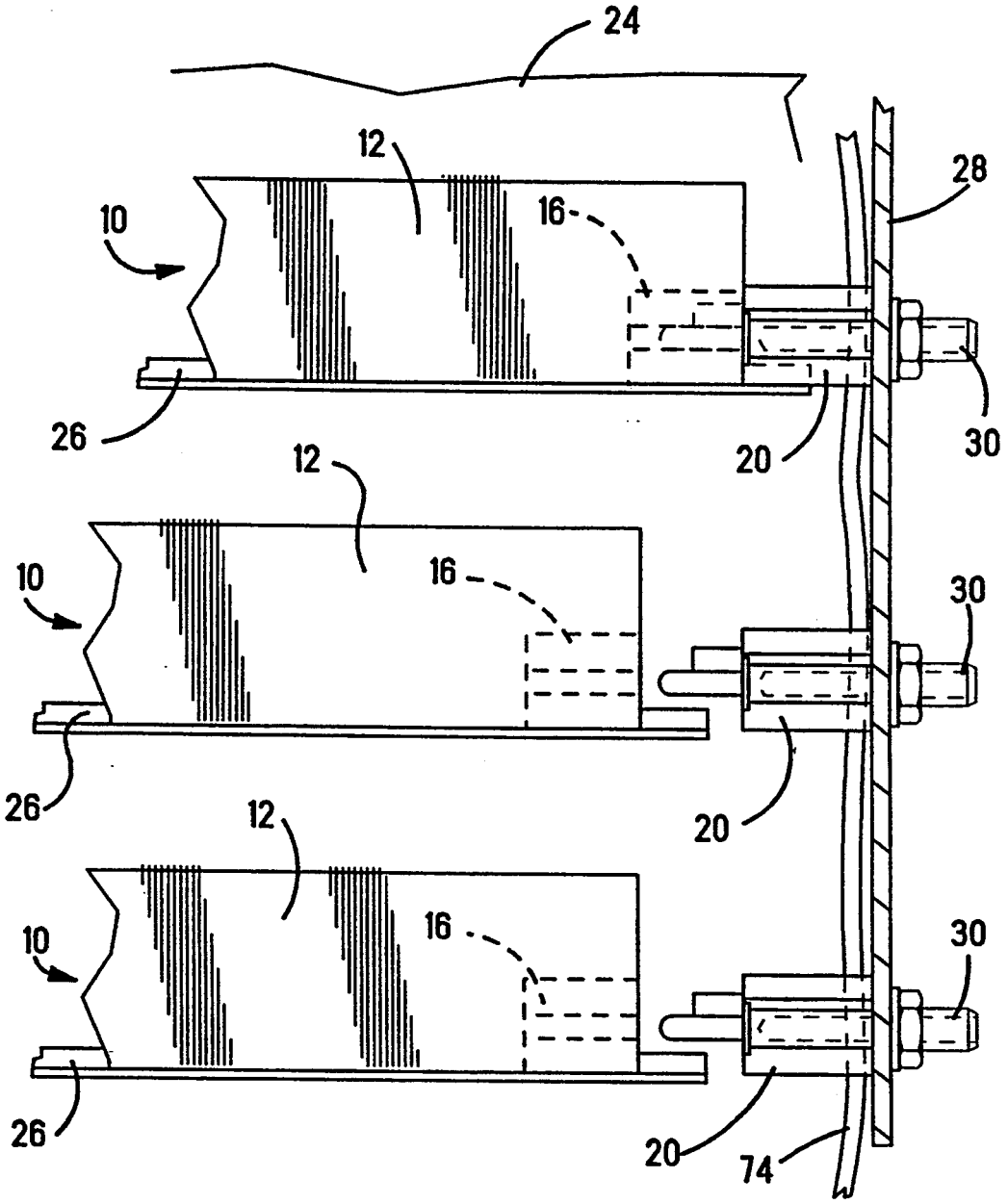
FIG. 4 is a cross-sectional view taken along the lines 4—4 of FIG. 2.

There is shown in FIG. 1 a unit of electronic equipment 10 having an outer case 12 with an opening 14 in an end thereof. The unit 10, in the present example, is a disc drive for use with computer equipment, not shown. A single mating composite connector 16, while shown external to the case 12, is mounted within the opening 14 so that it is flush with the end 18 of the case 12. The mating composite connector 16 mates with a composite connector 20, as shown in FIGS. 2 and 3. FIGS. 2 and 3 show a partial cross-sectional view of an equipment rack 24 where the unit 10 is arranged to slide into the equipment rack along a pair of guide rails 26 until the two connectors mate when the unit is fully inserted into the rack. The composite connector 20 is secured to a back panel 28 by means of the studs 30, in the case of front mounting as shown in FIG. 2, or by means of the screws 32, in the case of back mounting as shown in FIG. 3. The effective difference between front and back mounting of the composite connector 20 will be explained below, however, the front mounting yields more benefits. FIG. 4 is illustrative of multiple units 10 vertically stacked in the rack 24, each being guided by a pair of guide rails 26. The top most unit 10 is shown with its mating composite connector 16 in mating engagement with the composite connector 20, while the other two units 10 are shown only partially inserted into the rack 24.

Figure 5:
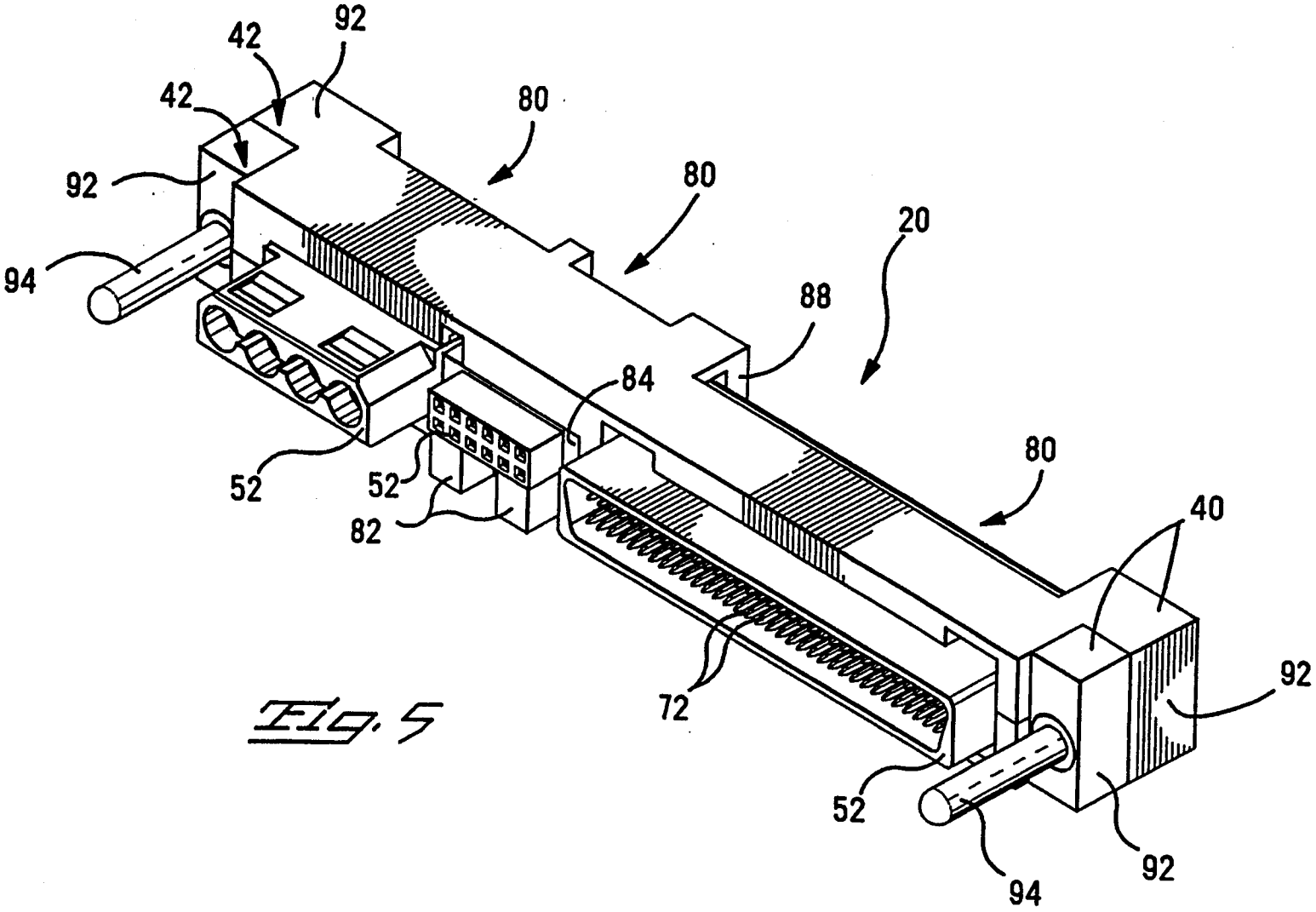
FIG. 5 is a perspective view of a connector in accordance with the teachings of the present invention.
Figure 6:
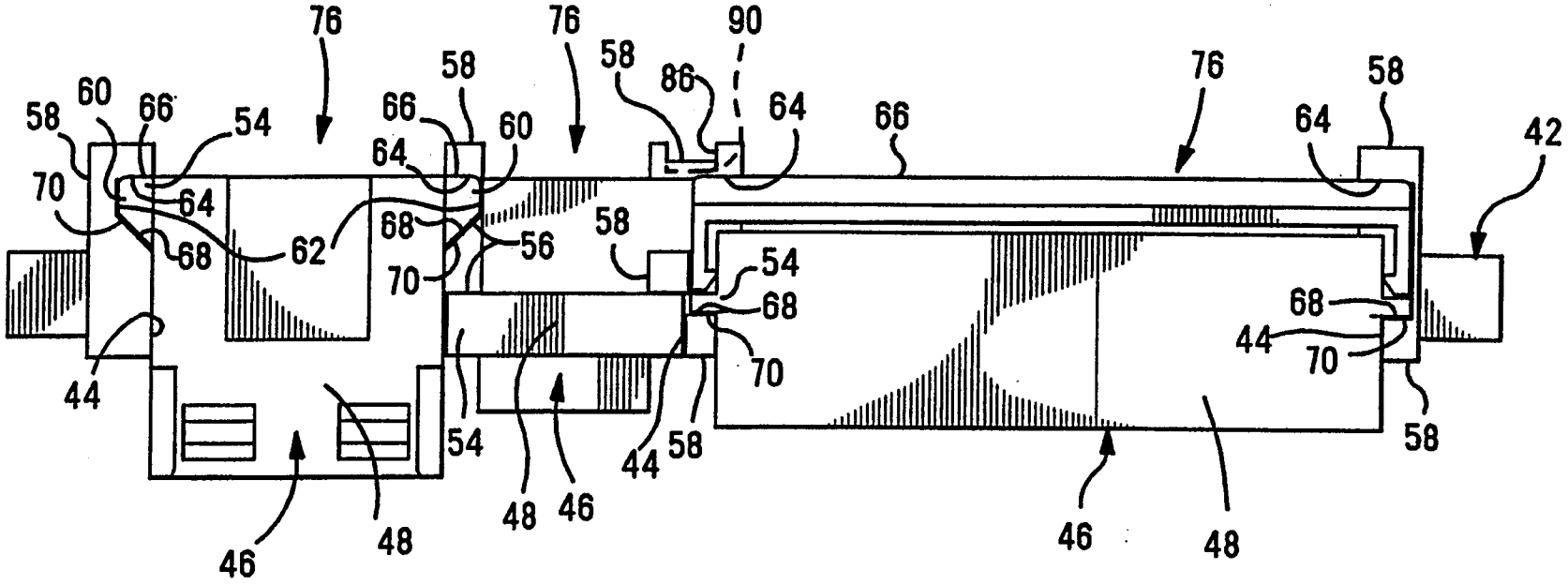
FIG. 6 is a top view of the connector of FIG. 5 with a portion of the housing removed.

The composite connector 20, as best seen in FIGS. 5 and 6, includes a housing 40 comprising first and second clasping bodies 42 that are each of molded, unitary construction, fabricated from a structural polymer material. The clasping bodies 42 oppose each other and define therebetween multiple housing cavities 44. Individual connectors 46 are secured within the cavities 44 and include a smaller one of the connectors 46 between two larger ones of the connectors 46. Each of the larger connectors 46 is both longer front to rear and wider laterally side to side than the smaller one of the connectors 46. Each connector 46 is constructed with an insulating housing 48 with an external profile. Each of the cavities 44 conforms to and engages some of the surfaces of these external profiles.

The housing receiving cavities 44 have open front ends through which protrude front mating faces 52 of the connectors 46. The individual connectors 46 have front mating faces 52 with different profile shapes. The front mating faces 52 are aligned laterally, side to side. As best seen in FIG. 6 the connectors 46 are shown mounted in the housing receiving cavities 44 of one of the clasping bodies 42. Relatively wide sections 54 of at least two of the connectors 46 overlap one another laterally, side to side, as shown at 56 to achieve a compact width for the connector 20. The relatively wide sections are in tandem and are spaced apart front to rear. Pillars 58 on each clasping body 42 project toward the other clasping body. The pillars 58 on one clasping body 42 stack on the pillars of the other clasping body. The pillars 58 extend between and separate the spaced apart, relatively wide portions 54 of the connectors 46. One of the larger connectors 46 has lateral, protruding, wedge shaped panel locks 60, and the pillars 58 of the clasping bodies have internal, wedge shaped recesses 62 conformingly surrounding the panel locks 60. Front facing surfaces 64 on the pillars 58 overlap rear facing surfaces 66, as shown in FIG. 6, on the connector 46 to resist relative movement of the connectors 46 and the clasping bodies 42. Rear facing surfaces 68 on the pillars 58 overlap front facing surfaces 70 on the connectors 46 to resist relative movement of the connectors 46 and the clasping bodies 42. As shown in FIG. 5, multiple electrical contacts 72 in each housing 48, shown in one of the connectors 46, are adapted to connect to insulated conductors electrical cables 74, shown in FIGS. 2, 3, and 4. The housing receiving cavities 44 defined by the clasping bodies 42 have open rear ends 76 to admit such conductors. Each of the housing receiving cavities 44 is intersected by a transverse cable exit, or cutout 80, as best seen in FIGS. 2, 3, and 5, that permit insulated conductors to exit each or the cavities 44 of the composite connector 20 transversely of the front to rear direction.

The smaller one of the connectors 46 is shorter than the larger connectors 46. At least one of the clasping bodies 42 is constructed with a bipartite post 82 that supports the shorter one of the connectors 46. Rear facing surfaces on the post 82 overlap a front facing surface encircling the smaller one of the connectors 46 to prevent movement of such connector relative to the clasping members 42. The post 82 supports the shorter one of the connectors 46 in vertical alignment, while side to side movement is limited by the wall of the cavity 42 and the adjacent connector 44. The shorter one of the connectors 46 has a shroud free mating face 52. As shown in FIGS. 5 and 6, an open end channel 86 is on a pillar 58 of one of the clasping bodies 42. An elongated hook 88 is on the other one of the clasping bodies 42 projecting toward the open end of the channel 86. The hook 88 is adapted to hook into an undercut 90 in the floor of the channel 86, and thereby interlock the clasping bodies 42 together. The channel 86 and hook 88 comprise interlocked locking members on the clasping bodies 42, the locking members being in tandem front to rear with a relatively shorter one of the connectors 46.

Block form ends 92 of the clasping bodies 42 overlap one another front to rear. Apertures in the ends 42 are aligned, front to rear. Guide pins 94 extend through the apertures and the aligned ends 92 of the clasping members 42. The guide pins 94 project forward of the mating face 52, and are used as alignment guides to align the composite connector 20 with the mating composite connector 16.

While the housing 40, in the present example, is composed of a pair a clasping bodies 42, the teachings of the present invention may be advantagously utilized with a housing of unitary construction. Such a housing may include any suitable structure such as a one piece molded or cast part.

When mounting the composite connectors 20 on the front of the back panel, as shown in FIGS. 2 and 4, there is no need to form openings in the back panel for the cables that are terminated to the individual connectors 46 to exit. The cables 74 are simply terminated to their respective connector 20 in the usual manner and routed out of the connector via the cutout 80 so that the cable is substantially parallel to and against the back panel. This arrangement permits, so called, daisy chaining multiple composite connectors 20 to a common cable 74 where the units 10 will permit circuits to be paralleled, such as in the largest of the three connectors 46, in the present example. This results in a neat cabling arrangement that is easy to install and to maintain. Rear mounting of the composite connector 20 to the back panel, as shown in FIG. 3, requires that openings be provided in the back panel 28 so that the individual connectors 46 are accessible for mating with the mating composite connector 16 carried by the unit 10. However, in this case the cabling is still effected in the same manner as that of front mounting by exiting via the cutouts 80, substantially parallel with the back panel 28.

An important advantage of the present invention is that the composite connector may be mounted to a back panel without the need for openings in the panel for exit cable. With this arrangement daisy chaining is greatly facilitated, resulting in simpler cable routing with corresponding cost benefits. Additionally, the composite connector 20 of the present invention permits the use of multiple existing connectors in a group while avoiding alignment problems associated with the use of these connectors individually to mate with the mating composite connector 16.

We claim:

1. The combination of an electrical connector of the type including a housing having a mating face and a mounting face, multiple cavities and multiple connectors in said cavities, walls of said cavities engaging the external profile of each of said multiple connectors to accurately position and hold them with respect to said housing, a back panel in an electrical equipment rack having a mounting surface to which said mounting face of said electrical connector is secured, flexible wires parallel to and on said mounting surface extending to said electrical connector and electrically connected thereto, and a unit of equipment in said rack having a mating connector associated therewith for mating to said electrical connector, said unit arranged to slide toward said back panel so that said mating connector mates with said electrical connector when said unit is fully inserted in said rack.

2. The combination according to claim 1 wherein said wires and said electrical connector, except mounting hardware, do not project into said mounting surface, nor extend through said panel.

3. The combination according to claim 1 wherein the front mating faces of longer ones of said multiple connectors are aligned side to side and relatively wide portions of the connectors are spaced apart front to rear, some of said wide portions overlapping one another laterally to achieve a compact width.

4. The combination according to claim 1 wherein said mounting face of said housing includes at least one cutout extending through a surface adjacent said mounting face and in communication with one of said cavities so that said wires may extend along said panel, into said cutout and electrically connect to the connector in said cavity.

5. The combination according to claim 4 wherein said cutout extends through two opposite surfaces adjacent said mounting face so that said wires extend into said cutout via one of said two surfaces and exit said cutout via the other of said two surfaces.

6. The combination according to claim 5 wherein said electrical connector has a longitudinal axis extending between said two opposite surfaces.

7. The combination according to claim 6 including a pair of guide pins projecting from opposite ends of said electrical connector in a direction opposite said mounting face, wherein said mating face is opposite said mating connector.

8. The combination according to claim 1 wherein said multiple connectors include at least two different connectors.

9. The electrical connector according to claim 1 wherein said housing is of unitary construction.

10. A combination of an electrical connector, a back panel in an electrical equipment rack and a unit of equipment, comprising:

a housing of said electrical connector having a mating face and a mounting face, multiple cavities and multiple connectors in said cavities, walls of said cavities engaging the external profile of each of said multiple conductors to accurately position and hold them with respect to said housing, a mounting surface of said back panel to which said mounting face is secured, flexible wires parallel to and on said mounting surface and electrically connected to and extending to said electrical connector, and a mating electrical connector in said unit of equipment for mating to said electrical connector, said unit of equipment being slidable in said electrical equipment rack and toward said back panel, and said mating electrical connector being slidable with said unit of equipment to mate with said electrical connector when said unit of equipment is slidable to a position of full insertion in said rack.

11. A combination of an electrical connector, a back panel in an electrical equipment rack and a unit of equipment as recited in claim 10, wherein, said wires and said electrical connector do not extend into said mounting surface and do not extend through said back panel.

12. A combination of an electrical connector, a back panel in an electrical equipment rack and a unit of as recited in claim 10, wherein, front mating faces of longer ones of said multiple connectors are aligned side to side, relatively wide portions of said multiple connectors are spaced apart front to rear, and some of said wide portions overlap one another laterally to achieve a compact width.

13. A combination of an electrical connector, a back panel in an electrical equipment rack and a unit of equipment as recited in claim 10, wherein, at least one cutout is in said mounting face, and is in communication with one of said cavities, and said wires extend along said panel and into said cutout and to at least one of said multiple electrical connectors in said one of said cavities.

14. A combination of an electrical connector, a back panel in an electrical equipment rack and a unit of equipment as recited in claim 13, wherein, said cutout extends through two opposite surfaces, and said wires extend into said cutout via one of said two surfaces and exits said cutout via the other of said two surfaces.

15. A combination of an electrical connector, a back panel in an electrical equipment rack and a unit of equipment as recited in claim 14, wherein a longitudinal axis of said electrical connector extends between said two opposite surfaces.

16. A combination of an electrical connector, a back panel in an electrical equipment rack and a unit of equipment as recited in claim 15, and further comprising: a pair of guide pins projecting from opposite ends of said electrical connector in a direction opposite said mounting face, wherein said mating face is opposite said mating connector.

17. A combination of an electrical connector, a back panel in an electrical equipment rack and a unit of equipment as recited in claim 10, wherein, said multiple connectors comprise at least two different connectors.

18. A combination of an electrical connector, a back panel in an electrical equipment rack and a unit of equipment as recited in claim 10, wherein, said housing is of unitary construction.

* * * * *